United States Patent [19]

Schreder

[11] Patent Number: 4,804,822

[45] Date of Patent: Feb. 14, 1989

[54] MOUNTING DEVICE FOR AN ELECTRIC COOKER PLATE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 911,478

[22] Filed: Sep. 25, 1986

[30] Foreign Application Priority Data

Oct. 2, 1985 [DE] Fed. Rep. of Germany ..... 3528062

[51] Int. Cl.[4] ..... H05B 3/68

[52] U.S. Cl. ..... 219/458

[58] Field of Search ..... 219/458, 459, 460

[56] References Cited

U.S. PATENT DOCUMENTS 2,772,340 11/1956 Schroeder ..... 219/458 X
4,348,581 9/1982 Fischer et al. ..... 219/458 X
4,414,466 11/1983 Fischer et al. ..... 219/459
4,491,722 1/1985 Fischer et al. ..... 219/458

FOREIGN PATENT DOCUMENTS 2755806 6/1979 Fed. Rep. of Germany ..... 219/458
2933349 3/1981 Fed. Rep. of Germany ..... 219/458

*Primary Examiner*—H. Broome
*Assistant Examiner*—Marvin M. Lateef
*Attorney, Agent, or Firm*—Steele, Gould & Fried

[57] ABSTRACT

A mounting device for an electric cooker plate in which the relatively heavy cooker plate (11) is so mounted in a stove top plate (19) of glass, that even during transportation, destruction of the glass stove top plate under lateral impacts will not, or is unlikely to, occur. The device includes U-shaped centering U-profiles (46) which are mounted on the inner face of an insert ring (31), which rests in a rubber profile (26) surrounding the mounting opening (50), the insert ring and rubber profile absorbing the affects of the impacts.

8 Claims, 1 Drawing Sheet

MOUNTING DEVICE FOR AN ELECTRIC COOKER PLATE

BACKGROUND OF THE INVENTION

This invention relates to a mounting device for an electric cooker plate.

The specification of DE-OS No. 33 17 624 discloses a mounting device for an electric cooker plate, comprising a body having a substantially axially orientated rim and which is surrounded by at least one support ring of sheet metal for installation in an opening of a stove top plate, which is preferably of glass or ceramic. The outer edge of the support ring bears upon the stove top plate. A seal is incorporated between an insert ring completely covered by the support ring and the aperture edge of the stove top plate, the seal being centered by the insert ring. L-shaped lugs are disposed internally on the insert ring, pointing towards the rim of the cooker plate and are intended for positioning and centering the cooker plates in the centre of the mounting opening. It has been found that this arrangement is satisfactory for installation and operation, but is not adequate for the heavier loads encountered in transporting it. The lugs tend to bend upwards or downwards with the result that the cooker plate becomes off-centre, and permanent deformations occur to the inbuilt components, rendering the cooker top unsaleable. This occurs particularly when packaged cooker tops fall on their edges during transporting. An object of the present invention is to create a mounting device which can withstand relatively heavy transport loadings.

SUMMARY OF THE INVENTION

According to the invention there is provided a mounting device for an electric cooker plate, comprising a cooker plate body having a substantially axially orientated rim and which is surrounded by at least one support ring such that when the plate is installed in an aperture of a cooker top plate an outer edge of the support ring bears upon the cooker top plate, an insert ring below the support ring, a seal between the insert ring and the aperture edge of the cooker top plate, which seal is centered by the insert ring, the insert ring having, on its inner surface, projections for positioning and centering the cooker plate, the projections possessing linear or strip-shaped bearing surfaces arranged axially of the insert ring and of the cooker plate rim, so that they lie along a generatrix of the cooker plate rim.

It has been found that, where projections having linear or strip-shaped bearing surfaces are used, especially U-shaped profiles, cooker plates and stove top plates of glass or ceramic also withstand heavy loadings even under severe impact on a narrow edge. Although it might be thought that energy is absorbed by the flexing of the L-shaped lugs according to the prior disclosure, the amount of destruction in such cases has been severe. According to the invention, the projections are less subject to the risk of bending. This is due mainly to the fact that the loading is absorbed over a relatively wide region and in the direction of the projections, which are directed mainly radially towards the centre. The relatively thin insert ring can indeed deform somewhat, but it does this mainly in the elastic range and is supported by the seal. The seal accepts the necessary deformation movement without undergoing plastic deformation. The cooker plate, therefore, after such a lateral impact loading is again accurately centered as before.

The linear bearing of the projections against or towards the rim of the cooker plate ensures that the loading on the insert ring is uniformly distributed vertically, thereby counteracting distortion of this ring due to the loading. A generally U-shaped profile having two projections, which is preferred, ensures that the loadings do not lead to a deformation of the insert ring. Under load, only radially outwardly orientated compressive force, with no bending, is transmitted to the insert ring. The projections should have relatively thick walls and be of relatively hard material. Profile sections or sheet metal stampings may be used.

Further advantages and features of the invention will be apparent from the sub-claims, description and drawing, it being possible for the individual features to be used each alone or to be combined together in the form of sub-combinations and in conjunction with other objects.

BRIEF DESCRIPTION OF THE DRAWING

One embodiment of a mounting device according to the invention will now be described by way of example with reference to the accompanying drawing, in which.

DESCRIPTION OF THE PREFERRED EMBODIMENT

Figure 1:
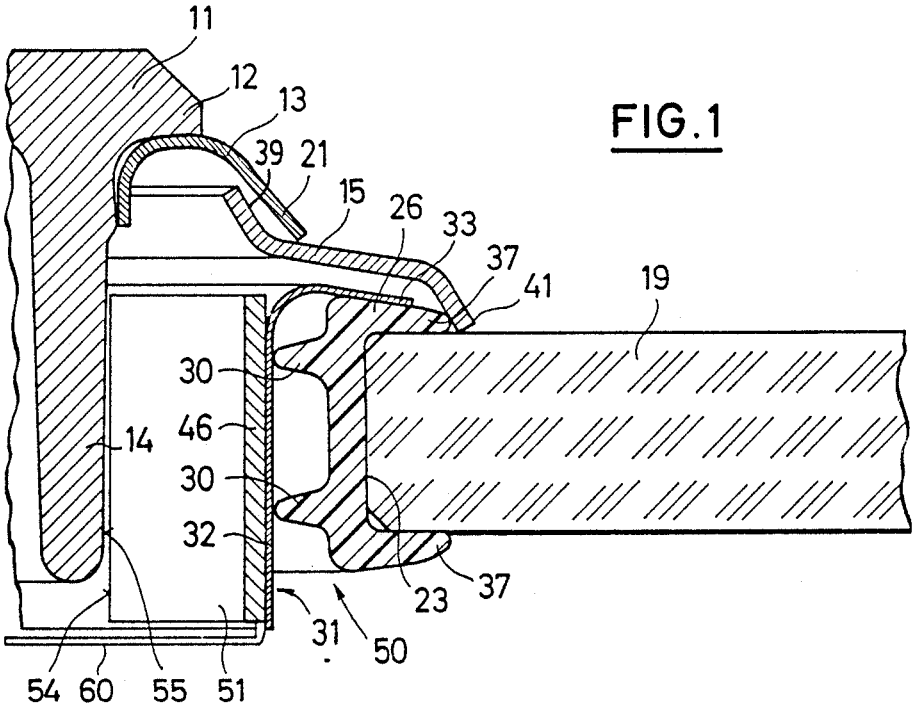
FIG. 1 is a vertical detail section through part of a mounting device for a cooker plate.
Figure 2:
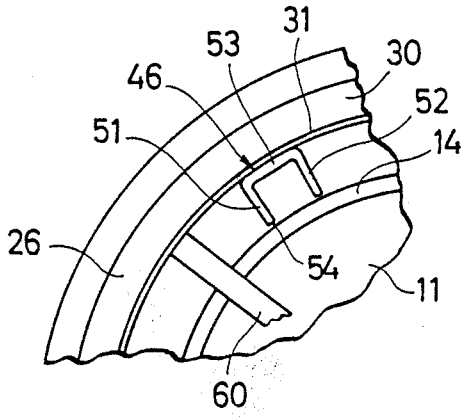
FIG. 2 is a partial view from below of the mounting arrangement.

In FIG. 1, an electric cooker hot plate 11 is partly shown, the cooker plate body of which is of a cast material such as cast iron. It possesses an upper, flat, closed cooking surface and is electrically heated from below by heating resistors in grooves in its lower face.

The cooker plate 11 has, at its upper, outer periphery, a projecting flange 12, against which an inner ring 13 of sheet metal bears from below. The ring 13 has an inverted, asymmetrical, generally U-shaped section, the outer arm 21 of which extends downwards and outwards obliquely at an angle of approximately 25°. The outer arm 21 of the inner ring 13 bears upon an outer ring 15, which may also be termed an intermediate ring, which together with the inner ring 13 forms a two-part support ring. The outer ring 15 has a flat, generally S-shaped cross-section. Its central region, descending outwards at a very flat angle, is adjoined internally and externally respectively by steeper inner and outer edges 39, 41, having a slope of approximately 60°. The outer ring, of sheet metal like the inner ring, has a relatively large width.

The outer edge 41 of the outer ring 15 rests on a stove top plate 19, which is of relatively thermal shock-resistant glass or ceramic. The flat stove top plate contains a plurality of openings 50 for cooker plates. The aperture edge 23 of the stove top plate 19 is encased by a seal 26, which has a generally U-shaped section with outwardly directed flanges or arms 37, covering the upper and lower edge regions. The seal 26 is made from a soft-elastic plastics material with relatively high heat resistance, and on its inner face possesses two projecting, annular circumferential ribs 30.

In the interior of the seal 26, adjacent to the ribs 30, an insert ring 31 is disposed, which is of a relatively thin sheet metal material of relatively high hardness and elasticity and has a generally L-shaped cross-section. It accordingly possesses an approximately cylindrical screening or shielding portion 32 and an upper flange 33, which is inclined slightly downwards corresponding to the form of the sealing ring 26. The flange 33 terminates somewhat before the end of the upper flange 37 of the seal 26, so that the outer periphery of the flange 37 bears against the inside of the outer edge 41 of the outer ring 15 and provides a sealing action there.

The insert ring 31 shields, with its shielding portion 32, the seal 26 from direct thermal radiation both from the cooker plate and from the interior of the support rings 13, 15, so that the seal is not at risk from overheating. Between the ribs 30 and the screening portion 32, insulating air spaces are formed. The screening portion 32 extends downwards to below the lower edge of the stove top plate 19 and of the seal and, perhaps also, of the outer rim of the cooker plate body, so that this screening portion forms a complete radiation shield.

A generally U-shaped profile 46 has a central portion 53 which is spot welded on the inner face of the insert ring 31. The profile has two flange projections 51, 52, which are directed away from the central portion 53 generally radially towards the cooker plate and radially of the insert ring. The profile is arranged axially of the insert ring, so that the projections 51, 52 lie along a generatrix of the approximately cylindrical cooker plate body outer rim 14, and at a relatively small spacing, so that they guide this rim between them. Their outer edges form bearing surfaces 54, which are intended to bear against the outer periphery or cylindrical surface 55 of the cooker plate rim. The U-profile 46, which may be a sheet metal stamping, has a considerably greater wall thickness than the insert ring 31 and is very stable in form.

During assembly, the cooker plate is guided with its outer rim 14 inside the projections 51, 52 of the U-profiles 46, of which several, for example from four to eight but preferably six, are uniformly distributed around the internal periphery of the insert ring. If the assembled cooker top, with the cooker plate body 11 braced or clamped downwards by a central fixing, not illustrated, against a frame or housing which also carries the stove top plate 19, is subjected during transportation to a high transverse acceleration, for example by the packaged cooker top falling onto one narrow edge, then the relatively heavy cooker plate 11 acts like a hammer, tending to strike the inner face of the mounting opening. The forces thus occurring are transmitted via the bearing surfaces 54 and the flanges 51, 52 to the insert ring 31, the relatively rigid U-profile remaining undeformed and transmitting the force over a large area via the rigid central portion 53 onto the interior of the insert ring 31. The latter ring can deflect elastically and transmits the forces and deformations over a relatively large circumferential portion onto the ribs 30 of the soft-elastic seal 26. These ribs can deflect elastically and absorb the impact effects of the cooker plate. Both the seal and the insert ring 31 can, on account of their elasticity, spring back after the impact. It will therefore be understood that, due to the relatively large number and stiffness of the U-profiles, this mounting assembly can accept even fairly large transverse forces without damage.

A generally radial grounding strip 60 may be fixed to the insert ring and extend to the central fixing bolt of the cooker plate to ensure complete earthing of all the components.

I claim

1. A mounting device for mounting an electric cooker plate in an aperture formed in a cooker top plate, the mounting device comprising:

a cooker plate body having a substantially axially oriented rim, at least one support ring surrounding said cooker plate body such that when the cooker plate is installed in an aperture of the cooker top plate, an outer edge of the support ring bears upon the cooker top plate, an insert ring below the support ring, spaced from and surrounding the cooker plate rim, a seal between the insert ring and an edge of the aperture of the cooker top plate, which seal is centered by the insert ring, the insert ring having, on its radial inner surface, projections projecting towards the cooker plate rim for positioning and centering the cooker plate, the projections possessing linear or strip-shaped bearing surfaces arranged axially of the insert ring and of the cooker plate rim, so that they lie along a generatrix of the cooker plate rim, whereby the cooker plate is centered without loading distortion of the insert ring.

2. A mounting device for mounting an electric cooker plate in an aperture formed in a cooker top plate, the mounting device comprising a cooker plate body having a substantially axially orientated rim, at least one support ring surrounding said cooker plate body such that when the plate is installed in an aperture of the cooker top plate an outer edge of the support ring bears upon the cooker top plate, an insert ring below the support ring, a seal between the insert ring and the aperture edge of the cooker top plate, which seal is centered by the insert ring, the insert ring having, on its inner surface, projections for positioning and centering the cooker plate, two of said projections are provided as flanges of one substantially U-shaped profile, which is arranged axially of and fixed to the inner face of the insert ring, the projections possessing linear or strip-shaped bearing surfaces arranged axially of the insert ring and of the cooker plate rim, so that they lie along a generatrix of the cooker plate rim.

3. A mounting device according to claim 2, in which the projections and their fixing portions which bear against the insert ring have a substantially greater thickness than the insert ring.

4. A mounting device according to claim 2, in which the projections are orientated substantially radially of the cooker plate and the mounting opening.

5. A mounting device according to claim 2, in which the insert ring comprises a substantially annular shielding portion for shielding the aperture edge, and an outwardly extending flange arranged to rest upon an upper flange of the seal, which upper flange rests upon the surface of the stove top plate adjacent to the aperture edge.

6. A mounting device according to claim 2, in which the flanges of the substantially U-shaped profile constituting the projections are spaced apart one from another at a distance smaller than the length of their bearing surfaces.

7. A mounting device according to claim 2, in which at least four, preferably six, substantially U-shaped profiles are mounted on the internal periphery of the insert ring, such as by spot welding.

8. A mounting device according to claim 2, in which the support ring is constructed in two parts; an inner ring bearing against the cooker plate body and an outer ring bearing against the stove top plate and resting upon this outer ring.

* * * * *